US009305513B1

(12) United States Patent
Novoselov et al.

(10) Patent No.: US 9,305,513 B1
(45) Date of Patent: Apr. 5, 2016

(54) ELECTROWETTING DISPLAY DEVICE CONTROL METHOD

(71) Applicant: Amazon Technologies, Inc., Seattle, WA (US)

(72) Inventors: Pavel Novoselov, Eindhoven (NL); Sukhdip Sandhu, Eindhoven (NL)

(73) Assignee: Amazon Technologies, Inc., Seattle, WA (US)

( * ) Notice: Subject to any disclaimer, the term of this patent is extended or adjusted under 35 U.S.C. 154(b) by 43 days.

(21) Appl. No.: 14/225,133

(22) Filed: Mar. 25, 2014

(51) Int. Cl.
*G09G 3/34* (2006.01)
*G09G 3/36* (2006.01)

(52) U.S. Cl.
CPC ..... *G09G 3/3696* (2013.01); *G09G 3/348* (2013.01)

(58) Field of Classification Search
None
See application file for complete search history.

(56) References Cited

U.S. PATENT DOCUMENTS

| | | | | |
|---|---|---|---|---|
| 2007/0001991 | A1 | 1/2007 | Jang et al. | |
| 2010/0177026 | A1 * | 7/2010 | Van Dijk et al. | 345/84 |
| 2010/0231566 | A1 * | 9/2010 | Feenstra et al. | 345/211 |
| 2013/0100176 | A1 * | 4/2013 | Lewis et al. | 345/690 |

FOREIGN PATENT DOCUMENTS

| | | | |
|---|---|---|---|
| WO | 2007049196 | A2 | 5/2007 |
| WO | 2008059038 | A1 | 5/2008 |
| WO | 2008059039 | A1 | 5/2008 |
| WO | 2010012831 | A1 | 2/2010 |

* cited by examiner

*Primary Examiner* — Joseph Haley
(74) *Attorney, Agent, or Firm* — BainwoodHuang

(57) ABSTRACT

A method of controlling an electrowetting display device with display elements arranged in a matrix with n rows. In examples each display element is addressable with a voltage pulse having a pulse duration longer than Tf/n, where Tf is a pre-determined frame period for addressing the n rows. In examples the pulse duration may be longer than ReCe, with Re being an electrical resistance of an electrically conductive fluid of a display element and Ce being an electrical capacitance of a capacitor of the display element.

20 Claims, 9 Drawing Sheets

Addressing at least one of n rows, theaddressingincluding: determining a value for a first pulse duration corresponding to a voltage pulse to be applied to switching elements corresponding respectively to display elements in the at least one of the n rows, the first pulse duration being longer than Tf/n, where Tf is a pre-determined frame period for addressing the n rows; generating the voltage pulse having the first pulse duration; and transmitting the voltage pulse to the switching elements corresponding respectively to the display elements in the at least one of the n rows

*FIG. 8*

Addressing at least one of the n rows, the addressing including: determining a value for a first pulse duration corresponding to a voltage pulse to be applied to switching elements corresponding respectively to display elements in the at least one of the n rows, the first pulse duration being longer than a value ReCe; generating the voltage pulse having the first pulse duration; and transmitting the voltage pulse to the switching elements corresponding respectively to the display elements in the at least one of the n rows

*FIG. 9*

ELECTROWETTING DISPLAY DEVICE CONTROL METHOD

BACKGROUND

Electrowetting display devices are known. The display elements of such a display device may be arranged in rows in an active matrix configuration. The display element includes a first and a second, immiscible fluid, the configuration of which can be controlled by a voltage applied to the display element. The configuration of the fluids determines a display state of the display element. The combination of display states of the display elements of the display device may form an image, visible to an observer.

It has been observed that application of a certain voltage to a display element in an active matrix configuration does not result in the desired effect, such as an effective reduction of backflow in the display element or the attainment of a desired display state.

It is desirable to improve the control of the display element.

BRIEF DESCRIPTION OF DRAWINGS

FIGS. 8 and 9 show flow diagrams of example control methods;

DETAILED DESCRIPTION

Figure 1:
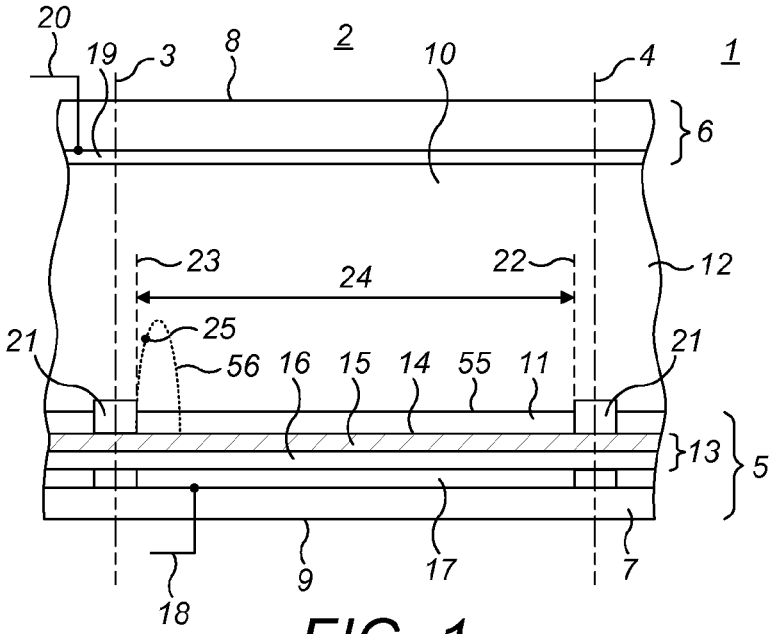
FIG. 1 shows schematically an example display element.

FIG. 1 shows a diagrammatic cross-section of part of an example of an electrowetting display device 1, including a plurality of picture elements or display elements 2, one of which is shown in the Figure and which may also be referred to as an electrowetting cell. The lateral extent of the display element is indicated in the Figure by two dashed lines 3, 4. The display elements comprise a first support plate 5 and a second support plate 6. The support plates may be separate parts of each display element, but the support plates may be shared in common by the plurality of display elements. The support plates may include a glass or polymer substrate 6, 7 and may be rigid or flexible.

The display device has a viewing side 8 on which an image or display formed by the display device can be viewed and a rear side 9. In the Figure a surface of the first support plate 5, which surface is in this example a surface of the substrate 7, defines the rear side 9; a surface of the second support plate 6, which surface is in this example a surface of the substrate 6, defines the viewing side; alternatively, in other examples, a surface of the first support plate may define the viewing side.

The display device may be of the reflective, transmissive or transflective type. The display device may be of a segmented display type in which the image may be built up of segments, each segment including several display elements. The display device may be an active matrix driven display device. The plurality of display elements may be monochrome. For a color display device the display elements may be divided in groups, each group having a different color; alternatively, an individual display element may be able to show different colors.

A space 10 of each display element between the support plates is filled with two fluids: a first fluid 11 and a second fluid 12 at least one of which may be a liquid. The second fluid is immiscible with the first fluid. Therefore, the first fluid and the second fluid do not substantially mix with each other and in some examples do not mix with each other to any degree. The immiscibility of the first and second fluids is due to the properties of the first and second fluids, for example their chemical compositions; the first and second fluids tend to remain separated from each other, therefore tending not to mix together to form a homogeneous mixture of the first and second fluids. Due to this immiscibility, the first and second fluids meet each other at an interface which defines a boundary between the volume of the first fluid and the volume of the second fluid; this interface or boundary may be referred to as a meniscus. With the first and second fluids substantially not mixing with each other, it is envisaged in some examples that there may be some degree of mixing of the first and second fluids, but that this is considered negligible in that the majority of the volume of first fluid is not mixed with the majority of the volume of the second fluid.

The second fluid is electrically conductive or polar and may be water, or a salt solution such as a solution of potassium chloride in water. The second fluid may be transparent; it may instead be colored, white, absorbing or reflecting. The first fluid is electrically non-conductive and may for instance be an alkane like hexadecane or may be an oil such as silicone oil.

The first fluid may absorb at least a part of the optical spectrum. The first fluid may be transmissive for a part of the optical spectrum, forming a color filter. For this purpose the first fluid may be colored by addition of pigment particles or a dye. Alternatively, the first fluid may be black, i.e. absorb substantially all parts of the optical spectrum, or reflecting. A reflective first fluid may reflect the entire visible spectrum, making the layer appear white, or part of it, making it have a color.

The support plate 5 includes an insulating layer 13. The insulating layer may be transparent or reflective. The insulating layer 13 may extend between walls of a display element. To avoid short circuits between the second fluid 12 and electrodes arranged under the insulating layer, layers of the insulating layer may extend uninterrupted over a plurality of display elements 2, as shown in the Figure. The insulating layer has a surface 14 facing the space 10 of the display element 2. In this example the surface 14 is hydrophobic. The thickness of the insulating layer may be less than 2 micrometers and may be less than 1 micrometer.

The insulating layer may be a hydrophobic layer; alternatively, it may include a hydrophobic layer 15 and a barrier layer 16 with predetermined dielectric properties, the hydrophobic layer 15 facing the space 10, as shown in the Figure. The hydrophobic layer is schematically illustrated in FIG. 1 and may be formed of Teflon® AF1600. The barrier layer 16 may have a thickness, taken in a direction perpendicular the plane of the substrate, between 50 nanometers and 500 nanometers and may be made of an inorganic material like silicon oxide or silicon nitride or a stack of these (for example, silicon oxide-silicon nitride-silicon oxide) or an organic material like polyimide or parylene. The barrier layer may comprise multiple layers having different dielectric constants.

The hydrophobic character of the surface 14 causes the first fluid 11 to adhere preferentially to the insulating layer 13, since the first fluid has a higher wettability with respect to the surface of the insulating layer 13 than the second fluid 12. Wettability relates to the relative affinity of a fluid for the surface of a solid. Wettability may be measured by the contact angle between the fluid and the surface of the solid. The contact angle is determined by the difference in surface tension between the fluid and the solid at the fluid-solid boundary. For example, a high difference in surface tension can indicate hydrophobic properties.

Each display element 2 includes a first electrode 17 as part of the support plate 5. In examples shown there is one such electrode 17 per element. The electrode 17 is electrically insulated from the first and second fluids by the insulating layer 13; electrodes of neighboring display elements are separated by a non-conducting layer. In some examples, further layers may be arranged between the insulating layer 13 and the electrode 17. The electrode 17 can be of any desired shape or form. The electrode 17 of a display element is supplied with voltage signals by a signal line 18, schematically indicated in the Figure.

The support plate 6 includes a second electrode 19, which may extend between walls of a display element or extend uninterruptedly over a plurality of display elements 2, as shown in the Figure. The electrode 19 is in electrical contact with the conductive second fluid 12 and is common to all display elements. The electrode may be made of for example the transparent conductive material indium tin oxide (ITO). A second signal line 20 is connected to the electrode 19. Alternatively, the electrode may be arranged at a border of the support plates, where it is in electrical contact with the second fluid. This electrode may be common to all elements, when they are fluidly interconnected by and share the second fluid, uninterrupted by walls. The display element 2 can be controlled by a voltage V applied between the signal lines 18 and 20. The signal line 18 can be coupled to a matrix of control lines on the substrate 7. The signal line 20 is coupled to a display driving system.

The first fluid 11 in this example is confined to one display element by walls 21 that follow the cross-section of the display element. The cross-section of a display element may have any shape; when the display elements are arranged in a matrix form, the cross-section is usually square or rectangular. Although the walls are shown as structures protruding from the insulating layer 13, they may instead be a surface layer of the support plate that repels the first fluid, such as a hydrophilic or less hydrophobic layer. The walls may extend from the first to the second support plate but may instead extend partly from the first support plate to the second support plate as shown in FIG. 1. The extent of the display element, indicated by the dashed lines 3 and 4, is defined by the center of the walls 21. The area of the surface 14 between the walls of a display element, indicated by the dashed lines 22 and 23, is called the display area 24, over which a display effect occurs. The display effect depends on an extent that the first and second fluids adjoin the surface defined by the display area, in dependence on the magnitude of the applied voltage V described above. The magnitude of the applied voltage V therefore determines the configuration of the first and second fluids within the electrowetting element. In other words, the display effect depends on the configuration of the first and second fluid in the display element, which configuration depends on the magnitude of the voltage applied to the electrodes of the display element. The display effect gives rise to a display state of the display element for an observer looking at the display device. When switching the electrowetting element from one fluid configuration to a different fluid configuration the extent of second fluid adjoining the display area surface may increase or decrease, with the extent of first fluid adjoining the display area surface decreasing or increasing, respectively.

Figure 2:
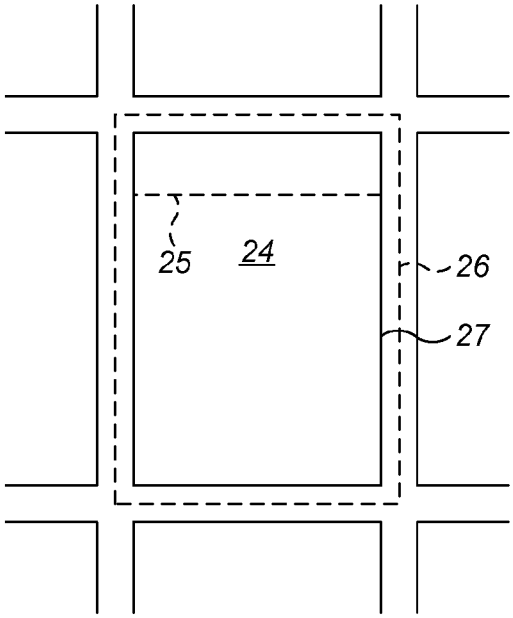
FIG. 2 shows a plan view of the example display element.

FIG. 2 shows a matrix of rectangular picture elements in a plan view of the hydrophobic surface 14 of the first support plate. The extent of the central picture element in FIG. 2, corresponding to the dashed lines 3 and 4 in FIG. 1, is indicated by the dashed line 26. Line 27 indicates the inner border of a wall; the line is also the edge of the display area 23.

When a zero or substantially zero voltage is applied between the electrodes 17 and 19, i.e. when the electrowetting element is in an off state, the first fluid 11 forms a layer between the walls 21, as shown in the FIG. 1. Application of a voltage will contract the first fluid, for example against a wall as shown by the dashed shape 25 in FIG. 1 or FIG. 2. The controllable shape of the first fluid, in dependence on the magnitude of applied voltage, is used to operate the picture element as a light valve, providing a display effect over the display area 23. For example, switching the fluids to increase adjoinment of the second fluid with the display area may increase the brightness of the display effect provided by the element.

This display effect determines the display state an observer will see when looking towards the viewing side of the display device. The display state can be from black to white with any intermediate grey state; in a color display device, the display state may also include color.

Figure 3:
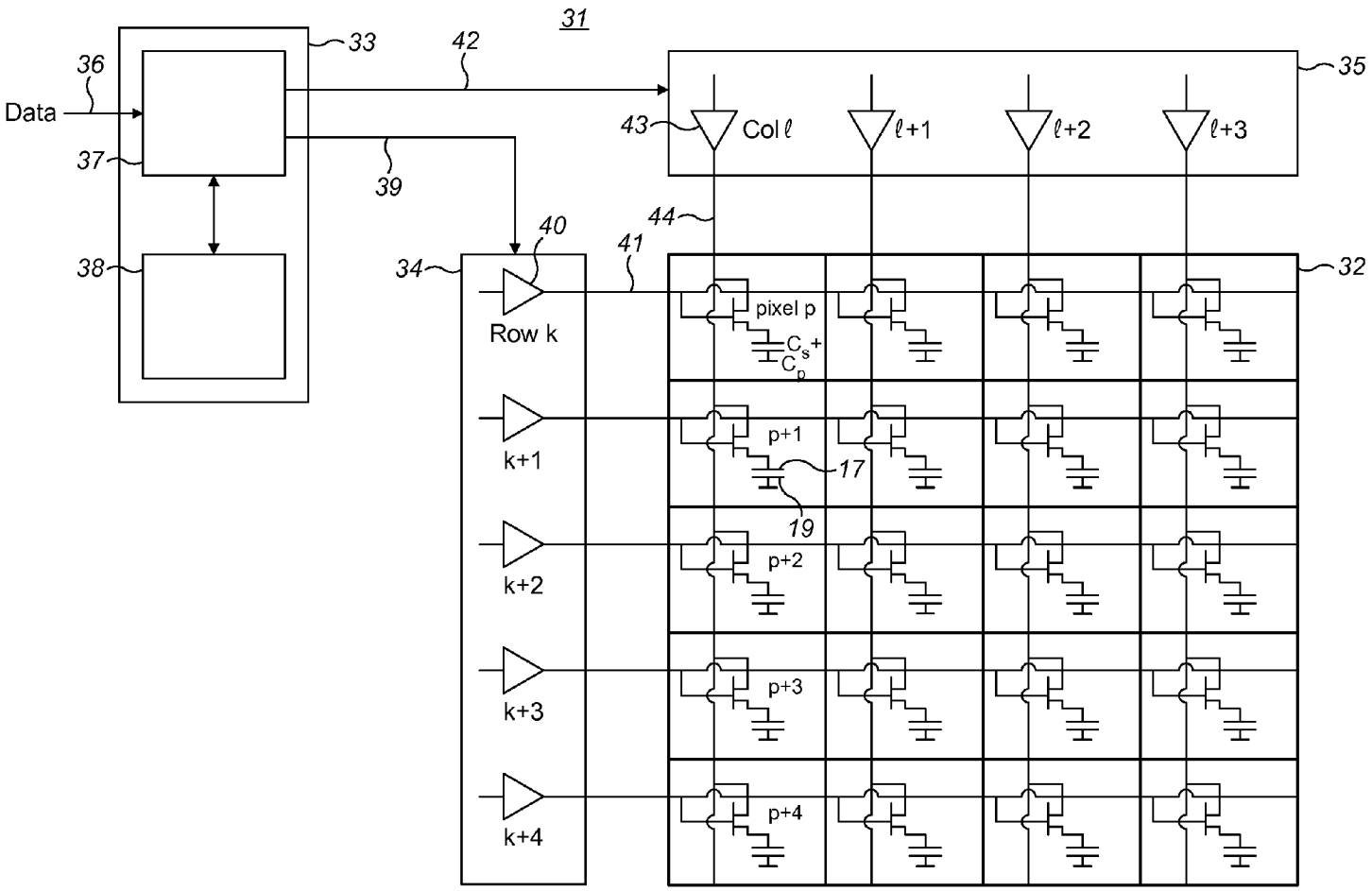
FIG. 3 shows schematically an example of an active matrix display apparatus.

FIG. 3 shows schematically an example electrowetting display apparatus 31. In this example of a so-called active matrix drive type the display apparatus includes a display driving system and a display device 32. The display driving system includes a display controller or controller 33, a display row driver 34 and a display column driver 35. Data indicative of display states of the display elements, the display states for example representing a still image or video images, is received via an input line 36 to the display driving system. The display controller includes a processor 37 for processing the data entered via the input line 36. The processor is connected to at least one memory 38. The display controller prepares the data for use in the display device.

The at least one memory may store computer program instructions that are configured to cause the display apparatus to perform one or more of the methods of controlling a display device as described when being executed by the processor. The computer program instructions may be stored on a computer program product including a non-transitory computer-readable storage medium.

An output of the processor 37 is connected by line 39 to the display row driver 34, which includes row driver stages 40 that transform signals to the appropriate voltages for the display device 32. Row signal lines 41 connect the row driver stages to respective rows of the display device 32 for transmitting the voltage pulses generated in the display row driver to display elements in each row of the display device, thereby providing a row addressing signal to each row of the display device. In other words, one or more voltage pulses for addressing one or more rows is transmitted over the row signal lines 41 corresponding to the rows to switching elements corresponding respectively to the display elements in the one or more rows. The display row driver 34 generates the voltage pulses used for addressing the rows of the display device, using information from the processor 37 to set a value of the pulse duration of the voltage pulses.

Another output of the processor 37 is connected by line 42 to the display column driver 35, which includes column driver stages 43 that transform signals to the appropriate voltages for the display device 32. Column signal lines 44 connect the column driver stages to the columns of the display device 32, providing a column signal to each column of the display device.

The display controller 33 determines which rows are selected for addressing and in which order. The selected rows are consecutively addressed by applying an addressing signal to each of these rows. The addressing may include the steps of determining a value for a first pulse duration corresponding to at least one voltage pulse to be applied to a row of display elements, generating the at least one voltage pulse having the first pulse duration and transmitting the at least one voltage pulse to the rows to be addressed. In examples where the display elements of a row are connected to the same row signal line, addressing a row means addressing each display element of that row. When a display element is being addressed, the display element admits the column signal that is applied to the column signal line to which the display element is connected. The column signal for a display element is applied substantially simultaneously with the voltage pulse used for addressing the display element. Substantially simultaneously means that the column signal is present on the column signal line for at least the pulse duration of the voltage pulse.

The display drivers may comprise a distributor, not shown in FIG. 3, for distributing data input to the display driver over a plurality of outputs connected to the driver stages. The distributor may be a shift register. FIG. 3 shows the signal lines only for those columns and rows of the display device that are shown in the Figure. The row drivers may be integrated in a single integrated circuit. Similarly, the column drivers may be integrated in a single integrated circuit. The integrated circuit may include the complete driver assembly. The integrated circuit may be integrated on the support plate 5 or 6 of the display device. The integrated circuit may include the entire display driving system.

The display device 32 comprises a plurality of display elements arranged in a matrix of n rows, where n may be ≥2, i.e. larger than one. The matrix may have an active matrix configuration. The matrix may have m columns, where m may be ≥2; the total number of display elements in this examples is n×m. FIG. 3 shows display elements for five rows, labelled k to k+4 and four columns labelled l to l+3. The total number of rows and columns for common display devices may range between a few hundred and a few thousand. The display elements, also called pixels, of column l are labelled p to p+4. Each display element may have the same construction as the display element 2 in FIG. 1.

FIG. 3 shows a few electrical elements of the display elements. Each display element of the display device 32 includes an active element in the form of one or more switching elements. The switching element may be a transistor, for example a thin-film transistor (TFT), or a diode. The electrodes of the display element are indicated as a pixel capacitor Cp formed by electrodes 17 and 19. A line connecting the electrode 19 of the capacitor to ground is the common signal line 20 and the line connecting the electrode 17 of the capacitor to the transistor is the signal line 18 shown in FIG. 1. The display element may include an optional capacitor Cs for storage purposes or for making the duration of the holding state or the voltage applied to the element uniform across the display device. This capacitor is arranged in parallel with Cp and is not separately shown in FIG. 3. The column drivers provide the signal levels corresponding to the input data for the display elements. The row drivers provide the signals for addressing the row of which the elements are to be set in a specific display state. In examples, addressing a row means applying a signal on the signal line of the row that switches a transistor of each of the display elements of the row to a conducting state of the transistor. Each row of the n rows of the display device is addressable by a signal such as a voltage pulse; the voltage pulse is applied to a switching element of each of the display elements in the addressed row for switching the switching element.

The addressing of rows is part of the addressing of display elements in an active matrix display device. A specific display element is addressed by applying a voltage to the column in which the specific display element is located and applying a voltage pulse to the row in which the specific display element is located.

When the transistor of a display element receives at its gate a voltage pulse of its row addressing signal, the transistor becomes conducting and it passes the signal level of its column driver to the electrode 17 of the electrowetting cell. In examples, a voltage pulse is a rapid, transient change in the voltage from a baseline value to a higher or lower value, followed by a rapid return, i.e. change, to the baseline value. The time period between the two subsequent voltage changes of the voltage pulse is called a pulse duration. After the transistor has been switched off, so the transistor is no longer conducting, the voltage over the cell will be substantially maintained until the transistor is switched on again by the next row addressing signal for the display element. The time during which the transistor is switched off is called the holding state of the element. In this active matrix driving method the electrodes of the electrowetting cells are connected to the driving stages briefly at the start of a period during which they show a certain display effect. During this connection, a voltage related to the desired display effect is applied to the electrodes. After the display element is disconnected from the driver stage, the voltage on the electrodes is substantially maintained by one or more capacitors during the period during which the display element shows the display effect. The method is called 'active', because the display element contains at least one active element, for example a transistor.

Figure 4:
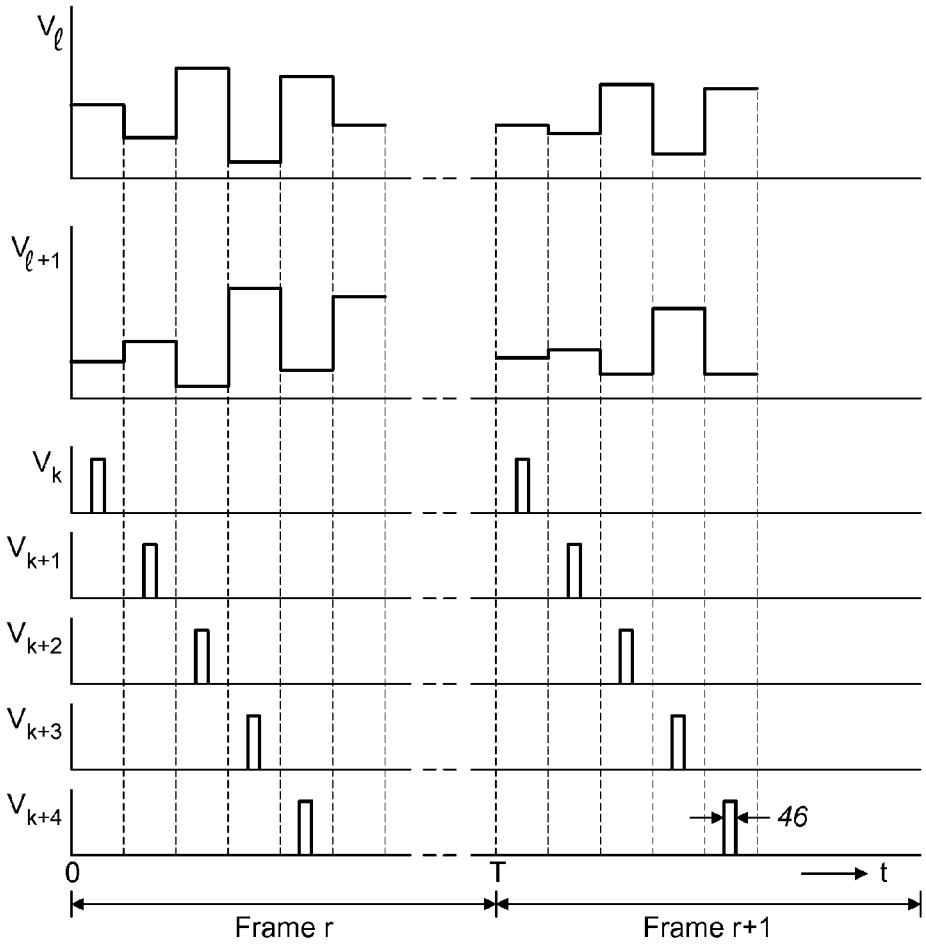
FIG. 4 shows a diagram of an active matrix driving method.

FIG. 4 shows a diagram of an example method of driving the display elements in a display device having an active matrix configuration. The method displays images during a series of frames, for example, an image is displayed within the duration of one frame. During a frame all display elements of a display device may be addressed; in a matrix all rows of the matrix of a display device are addressed during a frame. FIG. 4 shows two column signals Vl and Vl+1 and five row addressing signals Vk . . . Vk+4 as a function of time t for two consecutive frames r and r+1. The duration of a frame or frame period is Tf. In examples, a frame period Tf is a predetermined period for addressing the n rows of the matrix. In some examples the frame period is the period between consecutive addressing the same row. The duration of the period may be fixed, i.e. programmed, in the controller 33.

When row k is selected and addressed by a pulse on the row addressing signal Vk, as shown at the start of frame r in FIG. 4, the transistor in each display element of row k becomes conducting and the voltages on each of the column signal lines 44 will be put on the electrode 17 of each display element in row k. Subsequently, the display column driver 35 of FIG. 3 changes the voltages on the column signal lines to the values required for row k+1. When row k+1 is selected by a pulse on row addressing signal k+1, the voltages are put on the electrode 17 of FIG. 1 of the display elements of row k+1. All n rows of the display device will be selected consecutively in a similar manner in frame r. The process of selecting the rows starts again in the following frame r+1.

In common display apparatuses the pulse duration of the voltage pulse of the row addressing signal, also called the gate period Tg or gate time, is such that the n rows of the display device can be addressed consecutively within one frame period. Common display apparatuses have therefore usually a pulse duration equal to or less than Tf/n. For example, addressing 1000 rows in a frame period of 20 milliseconds requires a pulse duration of 20 microseconds or less. The pulse duration 46 in the example of a driving scheme shown in FIG. 4 is shorter than Tf/n.

When displaying an image on the display device, the voltage applied to the electrodes of a display element is related to the desired display state. In some display devices the quality of the image may be improved by applying reset pulses to the display elements. During a reset pulse a reset voltage, i.e. a voltage for resetting a display element, is applied to the display element. Such a reset pulse may be applied at any time during a frame period, for example at the start or at a time between the start and end of a frame period; the number of reset pulses may be applied once during several frames, once per frame or two or more times per frame. Reset pulses may be provided to avoid backflow. Backflow is a tendency of the first fluid and the second fluid of each of the display elements, during application of a voltage to the display element, to flow back to a configuration of the first and second fluid where no voltage is applied to the display element. In other words, it is the tendency of the first fluid in the electrowetting cell to flow back to a configuration of a closed state of the display element in spite of a voltage for an open state being applied. A reset pulse may for example reduce the applied voltage to zero for a sufficient duration of time to reduce backflow but still sufficiently short not to provide an observable display effect.

Figure 5:
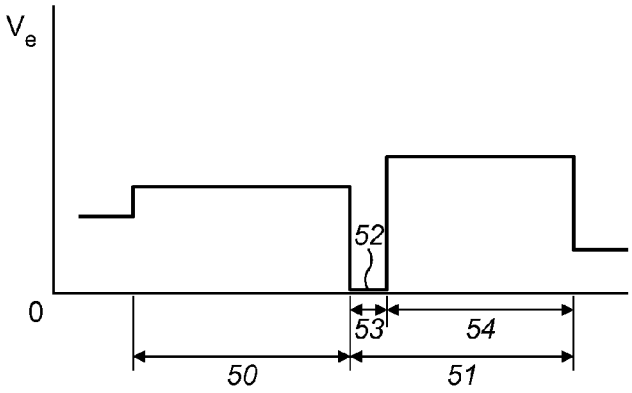
FIG. 5 shows a voltage diagram of a driving method.

FIG. 5 shows an example of use of a reset pulse. It shows a diagram of the voltage Ve applied between electrode 17 and electrode 19 of FIG. 1 of a display element for several consecutive frames. Frame 50 does not have a reset pulse. All display elements will be addressed in the frame and set to a voltage for the required display state. Frame 51 has a reset pulse 52 at the start of the frame. The reset pulse in this example has a reset voltage of zero volts and is a short excursion, i.e. change, of the applied voltage to zero volts and back to another voltage, for example a voltage applied to set a display state. The application of a reset pulse requires two addressing acts for the display elements within a relatively short period, one for applying the reset voltage and another one for applying another voltage such as a voltage applied to set a display state. In an active matrix configuration all display elements may be addressed in a first subframe 53 and set to a reset voltage and all display elements may be addressed again in a second subframe 54 and set to the voltage for the required display state. The first subframe 53 is relatively short because of the short duration of the reset pulse. The first subframe 53 and the second subframe 54 may also be called frame 53 and frame 54, respectively, because in each of these frames the rows of the display device are addressed. The application of a reset pulse prior to setting the display element to a display state in the addressing scheme of FIG. 4 may achieved by setting a zero voltage column signal Vl on all column signal lines for all rows during the frame r and setting voltages for the desired display states on the column signal lines during the following frame r+1.

The inventor has identified that the application of a reset pulse in a known display device may be less effective in reducing the backflow than expected and that the application of a voltage for a display state does not result in the expected display state. The following explanation of this phenomenon is presented as a possible explanation and is not to be considered limiting or binding. When a voltage is applied between the electrodes 17 and 19 of the display element shown in FIG. 1, charge will accumulate on the electrode 17 and on an interface 55 between the first fluid 11 and the second fluid 12 when the first fluid has not contracted. When the first fluid is contracted, as shown by the dashed line 25, the charge will accumulate on the electrode 17 and on the interface 14 between the second fluid and the insulating layer 13 and on the interface 56 between the first fluid and the second fluid. These charges provide the driving force that contract the first fluid from a layer configuration to the contracted configuration indicated by the dashed line 25.

When a voltage is applied between the electrodes 17 and 19, a charge will flow from the electrode 19 through the conductive second fluid 12 to the interface. Up to now it was assumed that the resistance of the second fluid was negligible and the flow of the charge through the second fluid did not affect the electrical properties of the display element. However, in some types of electrowetting display devices this resistance is not negligible and may affect the electrical properties, explaining the above mentioned smaller effect of the reset pulse and not obtaining the expected display state.

Figure 6:
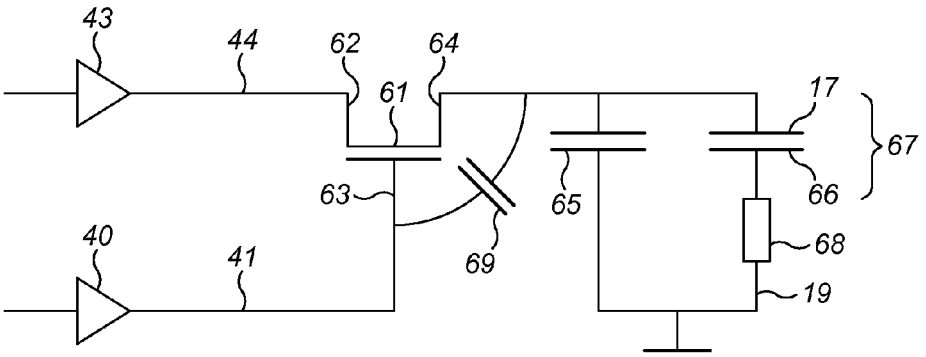
FIG. 6 shows a diagram of the electronic circuit in a display element.

FIG. 6 shows a diagram of an example electronic circuit in a display element, clarifying the effect of the resistance of the second fluid on the behavior of the display element. Identical elements in FIGS. 1, 3 and 6 have the same reference numeral. The output of the row driver stage 40 is connected to the row signal line 41. The output of the column driver stage 43 is connected to the column signal line 44. A switching element 61, a TFT in the present embodiment, has a source 62, a gate 63 and an emitter 64. The column signal line is connected to the source and the row signal line to the gate. A storage capacitor 65 having a capacitance Cs is arranged between the emitter and a common voltage, in the Figure indicated as ground. The emitter is also connected to the electrode 17 of the display element, forming a plate of an electrowetting capacitor 67. The interface 55 between the second fluid and the first fluid, or, when the first fluid is contracted, the interface 14 between the second fluid and the insulating layer plus the interface 56 between the second fluid and the contracted first fluid, forms another plate 66 of the electrowetting capacitor 67. The electrowetting capacitor has an electrical capacitance Ce, the value of which may depend on the configuration of the first and second fluid within the display element and the properties of the insulating layer 13. The resistance of the second fluid between the interface and the electrode 19 is shown as a resistor 68, connected between the plate 66 and the common voltage and having an electrical resistance Re. A parasitic capacitor 69 is shown between the emitter and the gate of the TFT 61, having a capacitance Cp.

Figure 7:
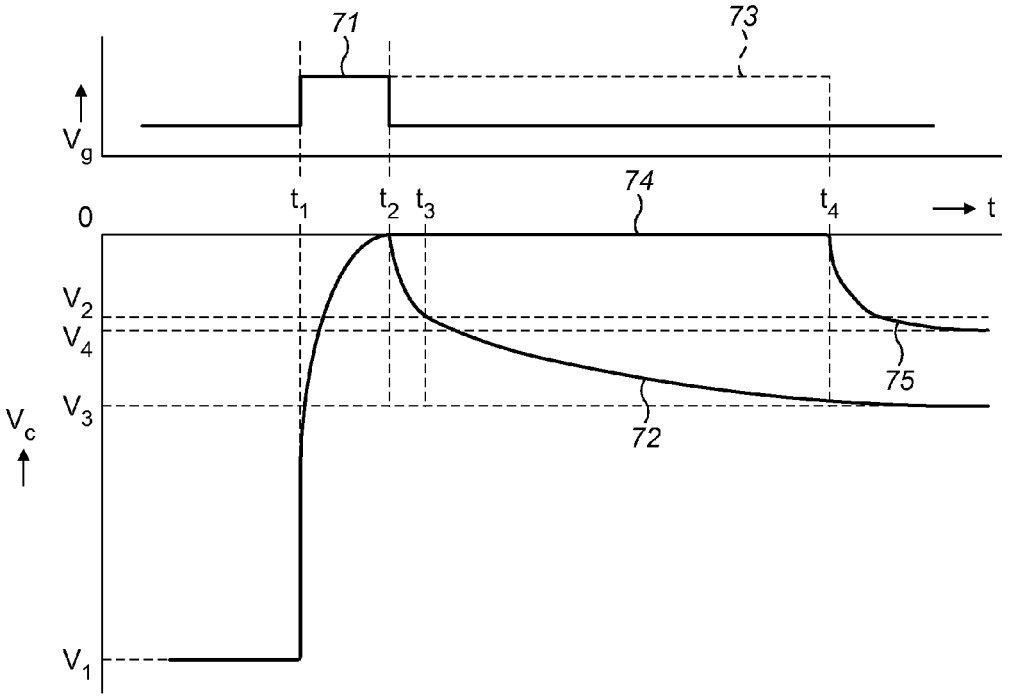
FIG. 7 shows a graph of a voltage over a storage capacitor of a display element.

FIG. 7 shows a graph of the voltage Vc over the storage capacitor 65 of a display element when the display element is being addressed and a graph of the voltage Vg applied to the gate of the TFT during the addressing. The voltage Vc is the same as the voltage Ve applied between the electrodes 17 and 19. The voltage Vc can be measured as a function of time for example on a relatively large display element including a TFT having a channel width of for example 1000 micrometers, a storage capacitor having a capacitance of 50 picofarads and a relatively large display area of for example 1 mm by 1 mm, having a pixel capacitance of for example 15 picofarads. The graphs in FIG. 7 show examples of the transition from a display state to a reset pulse having a zero reset voltage, as occurring for example in the transition from frame 50 to 53 in FIG. 5. A negative voltage Vc in the Figure means that the voltage on the electrode 19 is positive with respect to the voltage on the electrode 17.

Before the addressing of the present frame, starting at time t1, the voltage across the storage capacitor has a value V1, belonging to a display state of the preceding frame. At time t1 the addressing of the display element of the present frame starts with a positive pulse 71 at the row signal line 41, as shown in the graph of Vg. The pulse closes the TFT and the column voltage on the column signal line 44 is applied to the capacitors 69, 65 and 67. The voltage output by the column driver stage 43 changes from V1 to zero, zero volt being the intended level of the voltage for the reset pulse in the example shown. The voltage Vc drops to zero in a time depending on the internal resistance of the column driver stage 43, the resistance of the column signal line 44 and the capacitance of the capacitors. The addressing ends at time t2 with the end of the pulse at the gate; at t2 the TFT reverts to the open state. The pulse duration from t1 to t2 is 20 microseconds in the example. The display device is designed such that within the gate period or pulse duration the voltage Vc reaches substantially the intended level, i.e. zero volts in the example, as shown in the figure. The pulse duration t1-t2 is relatively short and is known to the person skilled in the art.

When the TFT opens at time t2, the voltage Vc decreases from zero to V2. The decrease is caused partly by the so-called kick-back effect, caused by the parasitic capacitor 69. The decrease in voltage of Vc due to the kick-back effect is proportional to the decrease of the gate voltage Vg at time t2 and depends on the capacitances of the capacitors 69, 65 and 67. When the maximum voltage change of the column driver stage is 20 V, the kick-back voltage V2 may be a few volts. The voltage change of Vc from zero to V2 due to the kick-back effect may occur in about 10 microseconds, depending on the values of various parameters of the display element and will be substantially completed by time t3; the period t2-t3 may for example be 10 microseconds.

If the value of the resistor 68 i.e. the resistance of the second fluid 12 as described above, is low, the voltage across the capacitor 67 will be substantially equal to Vc by the time t2 or t3. However, if the value of the resistor 68 is high, charge will still be flowing through the resistor when the TFT opens at time t2. Since the TFT is open, a charge redistribution will occur between the capacitors 65, 67 and 69. The relevant time for the redistribution is the RC time, which is well known to the skilled person as the product of the resistance R of a resistor and the capacitance C of a capacitor of a series circuit including the resistor and the capacitor. In examples described herein the value of the RC time is also referred to as ReCe in relation to the series circuit of the resistor 68 and the capacitor 67, i.e. ReCe is the product of the resistance Re of the resistor 68 and the capacitance Ce of the capacitor 67. In the example of the figure, charge on the capacitor 67 applied during the preceding frame will flow to the capacitors 65 and 69, decreasing the voltage Vc towards a final value of V3. When Vc has substantially reached the value V3, the voltage across the storage capacitor 65 will be substantially equal to the voltage across the capacitor 67.

FIG. 7 shows the exponential decrease 72 of Vc towards V3. The decrease starts at time t2, when the TFT opens; between time t2 and t3 the effect of the kick-back must be added. The value Re of resistor 68 may be 400 megaohms and the value Ce of the capacitor 67 may be 100 femtofarads in an example of an embodiment of the display element. The resulting RC time is 40 microseconds. The voltage V3 is about V1*Ce/(Cs+Cp+Ce) and can be a few volts. As a consequence, the voltage across the interface of the display element does not have the intended zero volt value of the reset pulse but a higher value, making the reset pulse less effective in reducing the backflow of the display element. Similarly, when applying a voltage of a certain level to the display element for setting it in a desired display state, the voltage across the interface may not reach this level and the desired display state may not be attained.

The effect of the resistor 68 can be reduced by using a longer pulse, increasing the pulse duration from t1-t2 to t1-t4, as shown in FIG. 7. The increased pulse duration assures that the TFT is still closed when the charge is flowing through resistor 68 and the column driver stage can supply or absorb the charge. The voltage across the capacitor 67 will become closer to the level of the column signal if the pulse duration is longer than ReCe. The longer pulse duration from t1 to t4 is shown in the trace of FIG. 7 by the drawn line 71 extended by the dashed line 73. During the pulse 73, the voltage Vc will be substantially zero volts, as shown by the line 74. At the end of the pulse, at time t4, the kick-back effect will cause a decrease of the voltage to V2, as shown in the Figure by line 75. Following the kick-back effect, the voltage will show a much smaller decrease below V2 than happened for the relatively short pulse 71 and shown by line 72. The voltage Vc using a relatively long pulse will decrease towards a final value of V4. When using the relatively short pulse duration known to the skilled person, the voltage across capacitor 67 will reach the value V3 instead of the intended zero voltage. When using the relatively long pulse duration, the voltage will reach the value V4, which is closer to the intended zero voltage.

When the pulse duration is longer than four times ReCe, the voltage across the capacitor 67 will be within 2% of the voltage obtained with an infinitely long pulse duration. The pulse duration may be made longer than six times ReCe, causing a voltage across the capacitor 67 within 1% of the voltage obtained with an infinitely long pulse duration.

The value of the time ReCe can be determined from the exponential change of the voltage Vc following time t3 after application of a relatively short gate pulse to a display element.

The long pulse duration may be achieved in a method of controlling a display device by selecting a long frame period. For example, if the matrix of the display device has n rows, the frame period Tf may be chosen longer than n*ReCe or n*4*ReCe. Each row of the matrix may now be addressed consecutively using a first pulse duration Tg longer than ReCe or 4*ReCe. The long pulse duration may be used for applying a reset pulse or for setting a display state or both for applying a reset pulse and for setting a display state.

In an alternative example method of controlling a display device having a matrix with n rows, with reference to FIG. 8, the long pulse duration may be achieved by addressing at least one of the n rows using a first pulse duration that is longer than Tf/n, where Tf is the frame period for addressing the n rows. The first pulse duration may be longer than the value ReCe. The first pulse duration may fit within a frame period by using gate periods or pulse durations of different length within a frame. For example, by addressing the rows of a first group of the rows using a first pulse duration and addressing the rows of a second group of the rows using a second pulse duration, the first pulse duration being longer than the second pulse duration. In another example method the longer pulse duration may fit within a frame period by addressing two or more, i.e. a plurality, of the n rows substantially simultaneously. Different pulse durations and simultaneous addressing may also be combined in a frame. Two rows are addressed substantially simultaneously if the display elements in the rows are addressed substantially simultaneously. The two rows may be addressed substantially simultaneously when each of said rows receives substantially simultaneously a voltage pulse on their respective row signal lines. Two display elements are addressed substantially simultaneously if the two periods of time the switching elements of the two display elements are closed at least partly overlap. Two display elements are addressed simultaneously if the two periods of time the switching element of the two display elements are closed completely overlap. Two display elements of the two rows, arranged in the same column, are addressed substantially simultaneously if a voltage on the column signal line of that column is applied to the two display elements.

Figure 10:
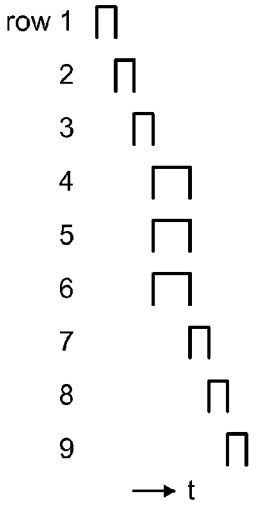
FIGS. 10-12 show methods of addressing the rows of a display device.

FIG. 10 shows an example method of controlling the rows of a display device. The figure shows nine consecutive rows and for each row schematically the voltage pulses for addressing the rows as a function of time t. The figure is similar to the traces for Vk–Vk+4 of FIG. 4 but is more schematic. The width of each voltage pulse in the figure is a measure of the pulse duration or gate period. A first group of the n rows, rows 4, 5 and 6 in the Figure, is addressed using a first pulse duration, a second group of the n rows, rows 1, 2, 3, 7, 8, 9 in the Figure, is addressed using a second pulse duration. The two groups are non-overlapping. The controller determines a first value for the first pulse duration and a second value for the second pulse duration, the first pulse duration being different from the second pulse duration; in the example of the Figure the first pulse duration is longer than the second pulse duration. This method of controlling is suitable for displaying for example pages with text on the display device. Rows 1, 2 and 3 are addressed by transmitting the voltage pulses for each row, each voltage pulse having the second pulse duration, consecutively for each row to the display elements in each row. Rows 4, 5 and 6 are addressed substantially simultaneously by transmitting the voltage pulse for each row, each voltage pulse having the first pulse duration, substantially simultaneously to the display elements in each row. Rows 7, 8 and 9 are addressed again consecutively using voltage pulses having the second pulse duration. With reference to FIG. 9, the first, longer pulse duration may be longer than the RC time of the display elements of the display device. The time necessary for the longer pulse durations is created by addressing the rows 4, 5 and 6 simultaneously, allowing use of the same frame period as when all rows would be addressed consecutively using the same shorter pulse duration. The simultaneous addressing of two or more rows may be achieved by generating a voltage pulse for each of the two or more rows and transmitting them simultaneously to the display elements of these rows. Alternatively, a single voltage pulse may be generated and transmitted to the display elements of the rows to be addressed simultaneously.

Figure 11:
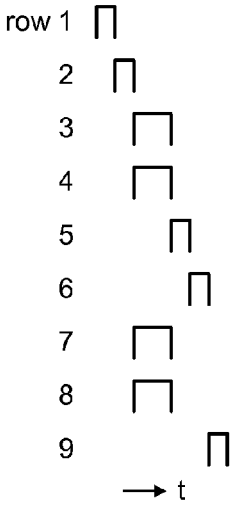

FIG. 11 shows an example control method where two or more, i.e. a plurality of, rows are arranged in two or more groups of rows, the groups being separated from each other by at least one further row. Rows 3 and 4 form a first group and rows 7 and 8 form a second group that is separated from the first group by two rows. Both groups are addressed simultaneously using a longer pulse duration. Rows not belonging to the groups are addressed consecutively in this example.

Figure 12:
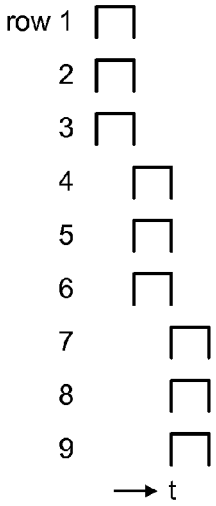

It is also possible to address all rows simultaneously using a longer pulse duration. However, the simultaneous addressing of all rows may become visible to an observer. The visibility may be reduced in a method as shown in FIG. 12. The method of controlling the rows of a display device uses the same pulse duration for each row and displays groups of rows consecutively and rows within a group simultaneously. The pulse duration may be longer than the RC time of the display element of the display device. The rows are addressed simultaneously in groups of three rows, the rows in each groups being addressed at different times within the frame period.

The rows addressed by a longer pulse duration in the examples of FIGS. 10 and 11 are also addressed simultaneously. However, rows addressed by a shorter pulse duration may also be addressed simultaneously, either with or without rows using a longer pulse duration being addressed simultaneously in the same frame.

The control methods shown in FIGS. 10-12 may be used for applying a reset pulse to the display elements. The long pulse duration causes the desired voltage to be applied to the interface, making the reset pulse more effective in reducing backflow. The control methods may also be used alternatively or in addition for applying a voltage to the display elements for setting the display element to a display state. Since the desired voltage will be applied to the interface, the display state of the display element will be closer to the display state indicated by the input data.

Figure 13:
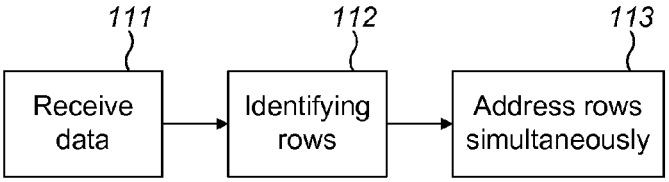
FIG. 13 shows a method of identifying rows.

When the method of examples is used for setting a display state, the rows that are addressed simultaneously should display similar display states. FIG. 13 shows a block diagram of an example method for identifying and selecting rows that can be addressed for display states simultaneously. In block 111 data is received for example by the processor 37 of FIG. 3, which data is indicative of display states of the display elements. At block 112, the plurality of rows are identified for which the data indicate substantially identical display states of the display elements within each column of said rows. The plurality of rows having the substantially identical display states are selected and addressed simultaneously in block 113. The method may be stored in the form of a computer program in the memory 38 and executed by the processor 37 in FIG. 3.

When rows are addressed simultaneously for setting display states, the display elements in a column of these rows will have the same display states. The method of FIG. 13 may therefore identify the rows where the display states of the display elements of the rows within each column should be substantially identical. Display states are for example substantially identical if they differ by less than a certain threshold value, for example less than a threshold value of 3 for a range of display effect grey scale values from 0 to 255. The application of the threshold value to input data may be performed by the processor, for identifying substantially identical display states. This allows the display of for example a checkerboard pattern in addressing actions, a first addressing action for addressing all rows in the odd rows of the checkerboard and a second addressing action for addressing all rows in the even rows of the checkerboard.

Alternatively, in other examples, the rows may be identified for which the data indicate the same or similar display states of the display elements in the rows. An example is an image of a page with text, where the rows making up the white space between the lines of text can be addressed simultaneously. All rows making up the white space of the entire frame may be addressed simultaneously or, to reduce any visibility of the simultaneous addressing, in groups. A group may include the rows making up the white space between two consecutive lines of text; the group may be addressed consecutively, the rows within a group may be addressed simultaneously.

Figure 14:
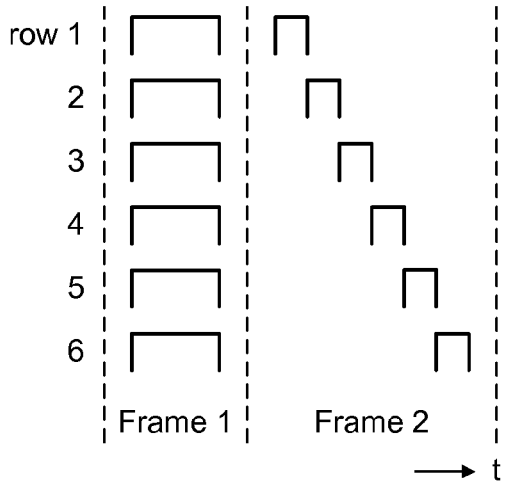
FIGS. 14-15 show methods of addressing the rows of a display device.

FIG. 14 shows an example method of controlling a display device applying both a reset pulse and a voltage for obtaining a display state of the display element. In frame 1 all rows, of which six are shown, are addressed simultaneously using a long pulse duration to apply a reset pulse to each display element of each row. The following frame 2 is used to address each row consecutively using a short pulse duration and applying a voltage according to the display state that the display element is intended to show. The long pulse duration may be longer than the RC time of the display elements. The frames are indicated by vertical dashed lines.

Figure 15:
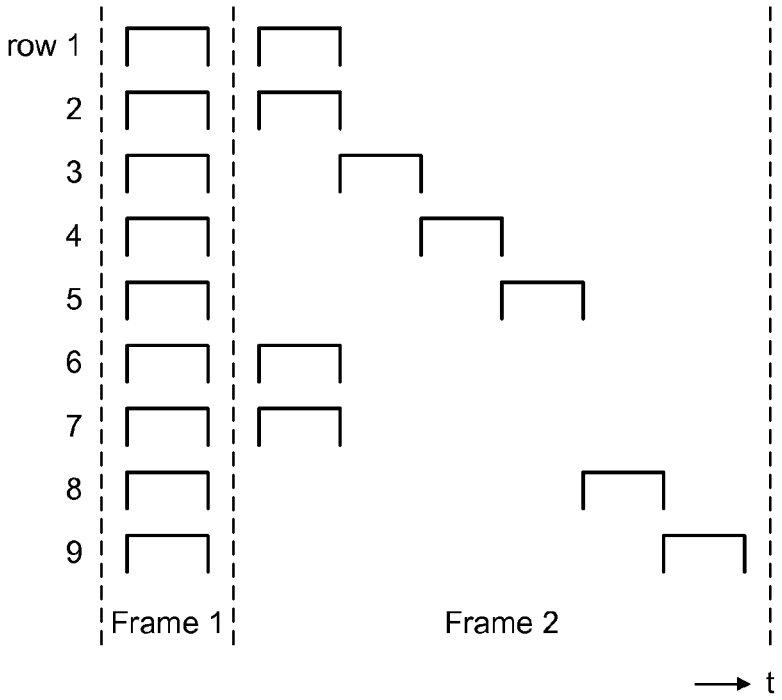

FIG. 15 shows an example method of controlling a display device also applying a reset pulse and a voltage for obtaining a display state, but groups of rows are addressed simultaneously for setting the display elements to a display state. In frame 1 a reset pulse is applied simultaneously to all rows using a long pulse duration. In consecutive frame 2 groups of rows 1, 2 and 6, 7 are simultaneously addressed first. The display elements in these rows may display the white spaces between lines of text. The other rows, 3, 4, 5, 8, 9, which may display the lines of text, are addressed consecutively.

Any of the various methods shown in FIGS. 10-12 and 14, 15 may be combined for applying reset pulses and/or applying a voltage for setting a display state.

The simultaneous driving of rows may reduce the power consumption of the display apparatus, because the voltages on the column signal lines 44 in FIGS. 3 and 6 need not be changed so often during a frame period as in a display apparatus where all rows are addressed consecutively. Since the parasitic capacitances of the column signal lines is substantially larger than the capacitances in the display elements, a reduction of the addressing cycles from for example nine to three as in FIG. 12 will reduce the power consumption by about a factor of three. When a page of text is displayed of which half of the image is white, the simultaneous addressing of rows may reduce the power consumption by a factor of about two.

Figure 16:
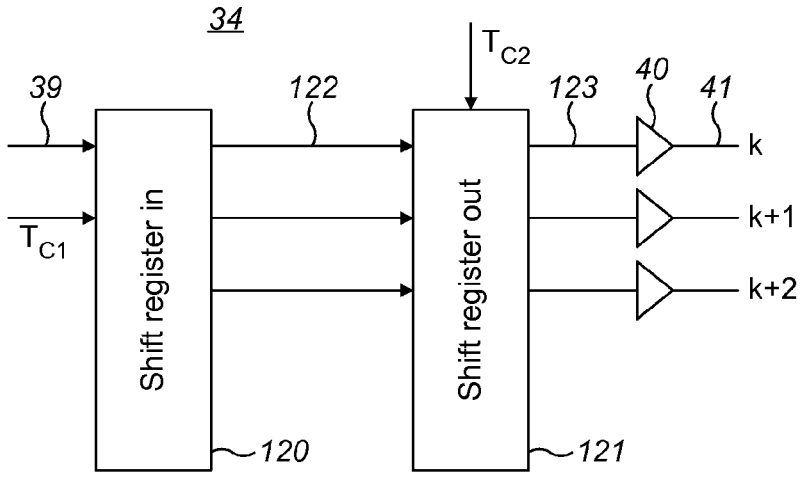
FIG. 16 shows a diagram of a display row driver.

FIG. 16 shows a diagram of an embodiment of the display row driver 34 for generating the voltage pulses for addressing the rows of the active matrix 32. The embodiment may generate voltage pulses of different duration within a frame and may also generate voltage pulses for simultaneous addressing rows. The processor 37 in FIG. 3 outputs data on the line 39. The data includes signals for controlling the addressing of the rows. The data is input in a programmable register, that may include a shift register In 120 and a shift register Out 121. The data on line 39 and a clock Tc1 are input in shift register In 120. The shift register In has n outputs 122 connected to respective inputs of the shift register Out 121, where n is the number of rows in the active matrix. The shift register Out 121 is controlled by a clock Tc2. The shift register Out 121 has n outputs 123, each of which is connected to the input of one of the row driver stages 40. The output of a row driver stage is connected to one of the row signal line 41 of the active matrix, as shown in FIG. 3. FIG. 16 shows the row driver stages for rows k, k+1 and k+2.

When the display device is controlled by consecutively addressing each of the n rows, as for example shown in Frame 2 of FIG. 14, the programmable register may operate as a conventional shift register. A single pulse is input in the shift register. At a clock pulse of Tc2 a voltage pulse is output to row k and the single pulse is moved one step forward in the shift register. At a second clock pulse, a voltage pulse is output to row k+1 and the single pulse is moved again one step forward in the shift register. After n clock pulses a voltage pulse has been transmitted to each of the n rows.

When the control of the display device uses simultaneous driving of rows and/or variable duration of the voltage pulse for addressing, the shift register In 121 may be used for loading a driving pattern and the shift register Out 122 for putting the driving pattern onto the row signal lines 41.

Figure 17:
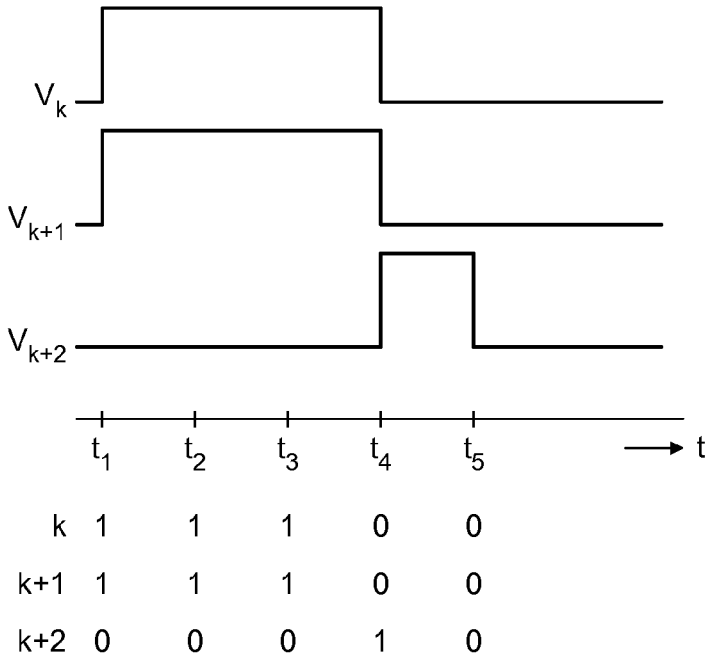
FIG. 17 shows a diagram of voltages and signals.

FIG. 17 shows a diagram of voltages and signals in the programmable register 120, 121 as a function of time t for an example of controlling a display device. Prior to time t1 data from the processor 37 is input the shift register In 120. The data for the n rows is input with n clock pulses of Tc1. The shift register In converts the serial input of the data into parallel data. The data values loaded into the shift register In prior to time t1 may be 110 for rows k, k+1 and k+2, as shown in the figure by the three digits below t1, here shown as 1, 1, 0. The digits may represent digital values. At time t1 a clock pulse of Tc2 loads the n data values into the shift register Out. In response the shift register Out outputs signals Vk, Vk+1 and Vk+2 as shown by the three traces in FIG. 17. Prior to time t2, new data is loaded into the shift register In, which is loaded into the shift register Out at a clock pulse of Tc2. Since the data for the three rows k, k+1 and k+2 is the same at t1 and t2, the output signals Vk, Vk+1 and Vk+2 will not change. At t3 again the same data is loaded into the shift register Out and the output signals do not change. At t4 the data changes to 0, 0, 1 and the voltages Vk and Vk+1 drop and Vk+2 increases. At t5 the data is 0, 0, 0, keeping the voltages Vk and Vk+1 at the same value as at t4 and decreasing the voltage Vk+2.

The pattern of voltages in FIG. 17 shows a voltage pulse having a long duration being input into row k; a voltage pulse also having a long duration being input simultaneously into row k+1; and a voltage pulse having a short duration being input into row k+2 after completion of the voltage pulses for the rows k and k+1. The long duration may be longer than the RC time of the display element of the display device. The pattern in FIG. 17 corresponds to the voltage pulses for rows 5, 6 and 7 in the example of FIG. 10.

By providing appropriate data from the processor 37 for the n rows at each time t, the voltage on each row signal line 41 can be controlled. It is possible to generate voltage pulses simultaneously for two or more rows and consecutively. It is also possible to control the pulse duration. The voltage patterns of in FIGS. 10, 11, 12 and 14 can be generated using the display row driver 34 shown in FIG. 16.

The above examples are to be understood as illustrative examples. Further examples are envisaged. For example, where it is stated that a device includes elements, each element having a property, for example having a switching element, this does not exclude that the device may also include elements that do not have the property, i.e. there may be elements without a switching element. Further, where the term simultaneously is used above, this in examples includes the meaning substantially simultaneously.

Figure 18:
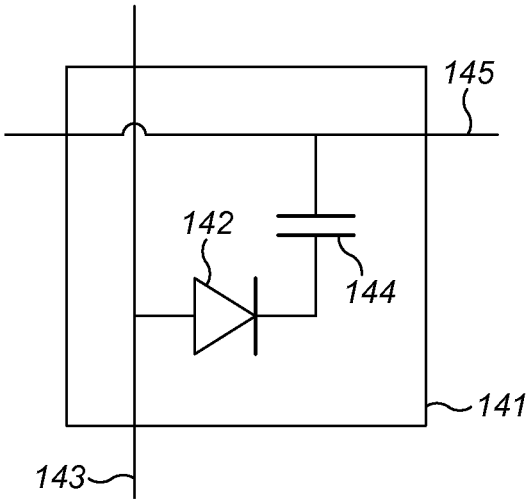
FIG. 18 shows an active matrix display element including a diode.

Whereas the switching element in the embodiment of the display device 32 shown in FIG. 3 is a transistor, it may alternatively be a diode in further examples. FIG. 18 shows an example of an active matrix display element 141 including a diode 142. The display element is similar to the display elements shown in FIG. 3. Two terminals of the diode are connected respectively to a column signal line 143 and to a pixel capacitor 144. The pixel capacitor is also connected to a row signal line 145, as shown in the figure. An addressing signal at the row signal line, such as a voltage pulse, will put the diode in a conducting state and a voltage depending on the voltage at the column signal line will be applied to the pixel capacitor. Using a long pulse duration for the row addressing will bring the voltage across the capacitor 144 closer to the intended value.

It is to be understood that any feature described in relation to any one example may be used alone, or in combination with other features described and may also be used in combination with one or more features of any other of the example, or any combination of any other of the examples. Furthermore, equivalents and modifications not described above may also be employed without departing from the scope of the accompanying claims.

What is claimed is:

1. A method of controlling an electrowetting display device comprising display elements arranged in a matrix having n rows, n being larger than one, each display element of the display elements having a corresponding switching element, the method comprising:

determining a value for a first pulse duration corresponding to a voltage pulse to be applied to the corresponding switching element of each display element of the display elements in at least one of the n rows, the first pulse duration being longer than Tf/n, Tf being a pre-determined frame period for addressing the n rows;

generating the voltage pulse having the first pulse duration; and transmitting the voltage pulse to the corresponding switching elements of each display element of the display elements in the at least one of the n rows.

2. A method according to claim 1, wherein the first pulse duration is longer than four times a value of ReCe, Ce being an electrical capacitance of a respective capacitor in each display element of the display elements, the respective capacitor being formed at least by a first electrode, a first fluid and a second fluid of a respective display element of the display elements, the second fluid being one or more of electrically conducting or polar, the second fluid being immiscible with the first fluid, Re being an electrical resistance of the second fluid, and the first electrode being electrically insulated from the first fluid and the second fluid.

3. A method according to claim 1, wherein the determining the value for the first pulse duration comprises determining a first value for the first pulse duration corresponding to at least one first voltage pulse to be applied to the corresponding switching elements of each display element of the display elements in a first group of the n rows;

the generating the voltage pulse having the first pulse duration comprises generating the at least one first voltage pulse having the first pulse duration; and the transmitting the voltage pulse comprises transmitting the at least one first voltage pulse to the corresponding switching element of each display element of the display elements in each row of the first group of the n rows, the method further comprising:

determining a second value for a second pulse duration corresponding to at least one second voltage pulse to be applied to the corresponding switching element of each display element of the display elements in a second group of the n rows, the first value of the first pulse duration being different from the second value of the second pulse duration;

generating the at least one second voltage pulse having the second pulse duration; and transmitting the at least one second voltage pulse to the corresponding switching element of each display element of the display elements in each row of the second group of n rows.

4. A method according to claim 1, wherein the generating the voltage pulse having the first pulse duration comprises generating at least one voltage pulse having the first pulse duration; and the transmitting the voltage pulse comprises transmitting the at least one voltage pulse substantially simultaneously to the corresponding switching elements of each display element of the display elements in at least two of the n rows.

5. A method according to claim 1, wherein the generating the voltage pulse having the first pulse duration comprises generating at least one voltage pulse having the first pulse duration; and the transmitting the voltage pulse comprises transmitting the at least one voltage pulse to the corresponding switching elements of each display element of the display elements in each of the n rows.

6. A method according to claim 1, wherein the corresponding switching element is a transistor having a gate and the voltage pulse is applied to the gate.

7. A controller for controlling an electrowetting display device, the controller comprising:

at least one processor; and at least one memory comprising computer program instructions, the at least one processor, the at least one memory and the computer program instructions being configured to cause the controller to perform a method of controlling an electrowetting display device comprising display elements arranged in a matrix having n rows, n being larger than one, each display element of the display elements having a corresponding switching element, the method comprising:

determining a value for a first pulse duration corresponding to a voltage pulse to be applied to the corresponding switching elements of each display element of the display elements in at least one of the n rows, the first pulse duration being longer than Tf/n, Tf being a pre-determined frame period for addressing the n rows;

generating the voltage pulse having the first pulse duration; and transmitting the voltage pulse to the corresponding switching elements of each display element of the display elements in the at least one of the n rows.

8. A controller according to claim 7, wherein the first pulse duration is longer than four times a value of ReCe, Ce being an electrical capacitance of a respective capacitor in each display element of the display elements, the respective capacitor being formed at least by a first electrode, a first fluid and a second fluid of a respective display element of the display elements, the second fluid being one or more of electrically conducting or polar, the second fluid being immiscible with the first fluid, Re being an electrical resistance of the second fluid, and the first electrode being electrically insulated from the first fluid and the second fluid.

9. A controller according to claim 7, wherein the determining the value for the first pulse duration comprises determining a first value for the first pulse duration corresponding to at least one first voltage pulse to be applied to the corresponding switching element of each display element of the display elements in a first group of the n rows;

the generating the voltage pulse having the first pulse duration comprises generating the at least one first voltage pulse having the first pulse duration; and the transmitting the voltage pulse comprises transmitting the at least one first voltage pulse to the corresponding switching elements of each display element of the display elements in each row of the first group of the n rows, the method further comprising:

determining a second value for a second pulse duration corresponding to at least one second voltage pulse to be applied to the corresponding switching element of each display element of the display elements in a second group of the n rows, the first value of the first pulse duration being different from the second value of the second pulse duration;

generating the at least one second voltage pulse having the second pulse duration;

transmitting the at least one second voltage pulse to the corresponding switching element of each display element of the display elements in each row of the second group of n rows.

10. A controller according to claim 7, wherein the generating the voltage pulse having the first pulse duration comprises generating at least one voltage pulse having the first pulse duration; and the transmitting the voltage pulse comprises transmitting the at least one voltage pulse substantially simultaneously to the corresponding switching elements of each display element of the display elements in at least two of the n rows.

11. A controller according to claim 7, wherein the generating the voltage pulse having the first pulse duration comprises generating at least one voltage pulse having the first pulse duration; and the transmitting the voltage pulse comprises transmitting the at least one voltage pulse to the corresponding switching elements of each display element of the display elements in each of the n rows.

12. A display apparatus comprising:

an electrowetting display device comprising display elements arranged in a matrix having n rows, n being larger than one, each display element of the display elements comprising:

a switching element;

a first fluid and a second fluid, the second fluid being one or more of electrically conducting or polar, and the second fluid being immiscible with the first fluid;

a first electrode electrically insulated from the first fluid and the second fluid; and a second electrode electrically connected to the second fluid, the first electrode, the first fluid and the second fluid at least forming a capacitor with an electrical capacitance Ce and the second fluid having an electrical resistance Re; and a controller for controlling an electrowetting display device, the controller comprising:

at least one processor; and at least one memory comprising computer program instructions, the at least one processor, the at least one memory and the computer program instructions being configured to cause the controller to perform a method of controlling the electrowetting display device, the method comprising:

determining a value for a first pulse duration corresponding to a voltage pulse to be applied to the switching element of each display element of the display elements in at least one of the n rows, the first pulse duration being longer than Tf/n, Tf being a pre-determined frame period for addressing the n rows;

generating a voltage pulse having the first pulse duration; and transmitting the voltage pulse to the switching element of each display element of the display elements in the at least one of the n rows.

13. A display apparatus according to claim 12, wherein the first pulse duration is longer than four times a value of ReCe.

14. A display apparatus according to claim 12, wherein the determining the value for the first pulse duration comprises determining a first value for the first pulse duration corresponding to at least one first voltage pulse to be applied to the switching element of each display element of the display elements in a first group of the n rows;

the generating the voltage pulse having the first pulse duration comprises generating the at least one first voltage pulse having the first pulse duration; and the transmitting the voltage pulse comprises transmitting the at least one first voltage pulse to switching elements of each display element of the display elements in each row of the first group of the n rows, the method further comprising:

determining a second value for a second pulse duration corresponding to at least one second voltage pulse to be applied to the switching element of each display element of the display elements in a second group of the n rows, the first value of the first pulse duration being different from the second value of the second pulse duration;

generating the at least one second voltage pulse having the second pulse duration; and transmitting the at least one second voltage pulse to the switching element of each display element of the display elements in each row of the second group of n rows.

15. A display apparatus according to claim 12, wherein the generating the voltage pulse having the first pulse duration comprises generating at least one voltage pulse having the first pulse duration; and the transmitting the voltage pulse comprises transmitting the at least one voltage pulse substantially simultaneously to the switching elements of each display element of the display elements in at least two of the n rows.

16. A display apparatus according to claim 12, wherein the generating the voltage pulse having the first pulse duration comprises generating at least one voltage pulse having the first pulse duration; and the transmitting the voltage pulse comprises transmitting the at least one voltage pulse to the switching elements of each display element of the display elements in each of the n rows.

17. A display apparatus according to claim 12, wherein the switching element is a transistor having a gate and the voltage pulse is appliable to the gate.

18. A method according to claim 1, wherein the first pulse duration is longer than a value of ReCe, Ce being an electrical capacitance of a respective capacitor in each display element of the display elements, the respective capacitor being formed by at least a first electrode, a first fluid and a second fluid of a respective display element of the display elements, the second fluid being one or more of electrically conducting or polar, the second fluid being immiscible with the first fluid, Re being an electrical resistance of the second fluid, and the first electrode being electrically insulated from the first fluid and the second fluid.

19. A controller according to claim 7, wherein the first pulse duration is longer than a value of ReCe, Ce being an electrical capacitance of a respective capacitor in each display element of the display elements, the respective capacitor being formed at least by a first electrode, a first fluid and a second fluid of a respective display element of the display elements, the second fluid being one or more of electrically conducting or polar, the second fluid being immiscible with the first fluid, Re being an electrical resistance of the second fluid, and the first electrode being electrically insulated from the first fluid and the second fluid.

20. A display apparatus according to claim 12, wherein the first pulse duration is longer than a value of ReCe.

* * * * *